US007175495B2

(12) United States Patent
Nakamoto et al.

(10) Patent No.: US 7,175,495 B2
(45) Date of Patent: Feb. 13, 2007

(54) METHOD OF MANUFACTURING FIELD EMISSION DEVICE AND DISPLAY APPARATUS

(75) Inventors: Masayuki Nakamoto, Chigasaki (JP); Atsuo Inoue, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 217 days.

(21) Appl. No.: 10/374,263

(22) Filed: Feb. 27, 2003

(65) Prior Publication Data

US 2003/0155859 A1 Aug. 21, 2003

Related U.S. Application Data

(62) Division of application No. 09/531,158, filed on Mar. 17, 2000, now abandoned.

(30) Foreign Application Priority Data

Mar. 19, 1999 (JP) ..... 11-076615
Mar. 30, 1999 (JP) ..... 11-089369

(51) Int. Cl.
*H01J 9/04* (2006.01)

(52) U.S. Cl. ..... 445/51; 445/50; 313/336; 313/351

(58) Field of Classification Search ..... 445/24, 445/49–51; 313/495–497, 309, 336, 351
See application file for complete search history.

(56) References Cited

U.S. PATENT DOCUMENTS 3,636,397 A * 1/1972 Addamiano et al. ..... 313/500
3,665,241 A 5/1972 Spindt et al.
4,513,308 A * 4/1985 Greene et al. ..... 313/351
4,551,649 A * 11/1985 Olson ..... 313/336
5,015,912 A 5/1991 Spindt et al.
5,070,282 A * 12/1991 Epsztein ..... 315/383
5,225,820 A 7/1993 Clerc
5,266,528 A * 11/1993 Yamada ..... 83/49
5,319,279 A 6/1994 Watanabe et al.
5,499,938 A 3/1996 Nakamoto et al.
5,652,474 A * 7/1997 Wilshaw et al. ..... 313/336

(Continued)

FOREIGN PATENT DOCUMENTS

JP 7-65706 3/1995

(Continued)

*Primary Examiner*—Joseph Williams
*Assistant Examiner*—German Colón
(74) *Attorney, Agent, or Firm*—Oblon, Spivak, McClelland, Maier & Neustadt, P.C.

(57) ABSTRACT

A method of manufacturing a field emission device having emitter shapes, comprise the steps of forming a first original plate having a major surface provided with emitter shapes, by cutting a surface portion of a base material, forming a first material layer on the major surface of the first original plate on which the emitter shapes are provided; separating the first material layer from the first original plate, thereby obtaining a second original plate having recesses onto which the emitter shapes on the first original plate are transferred, forming a second material layer on a major surface of the second original plate on which the recesses are provided; and separating the second material layer from the second original plate, thereby to obtain a substrate having projections portions onto which shapes of the recesses of the second original plate are transferred.

16 Claims, 14 Drawing Sheets

U.S. PATENT DOCUMENTS

| | | | |
|---|---|---|---|
| 5,727,976 | A | 3/1998 | Nakamoto et al. |
| 5,747,926 | A | 5/1998 | Nakamoto et al. |
| 5,749,762 | A | 5/1998 | Nakamoto et al. |
| 5,786,656 | A | 7/1998 | Hasegawa et al. |
| 5,808,408 | A | 9/1998 | Nakamoto |
| 5,834,324 | A | 11/1998 | Nakamoto |
| 5,977,693 | A | 11/1999 | Nakamoto et al. |
| 6,031,328 | A | 2/2000 | Nakamoto |
| 6,097,138 | A | 8/2000 | Nakamoto |
| 6,184,611 | B1 * | 2/2001 | Saito et al. ..... 313/310 |

FOREIGN PATENT DOCUMENTS

| | | | |
|---|---|---|---|
| JP | 7-254383 | | 10/1995 |
| JP | 08111171 | A * | 4/1996 |
| JP | 10-148829 | | 6/1998 |
| JP | 10-208623 | | 8/1998 |
| JP | 10-208624 | | 8/1998 |

* cited by examiner

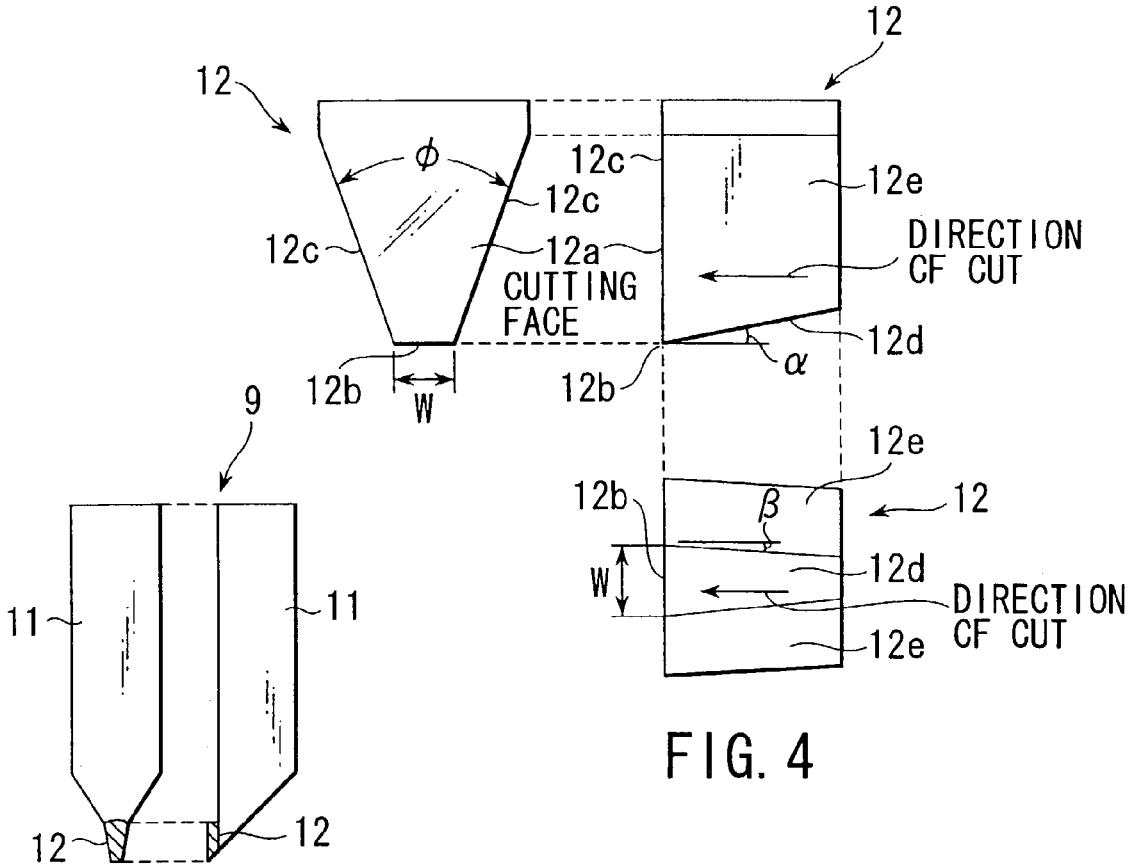
FIG. 4
FIG. 3
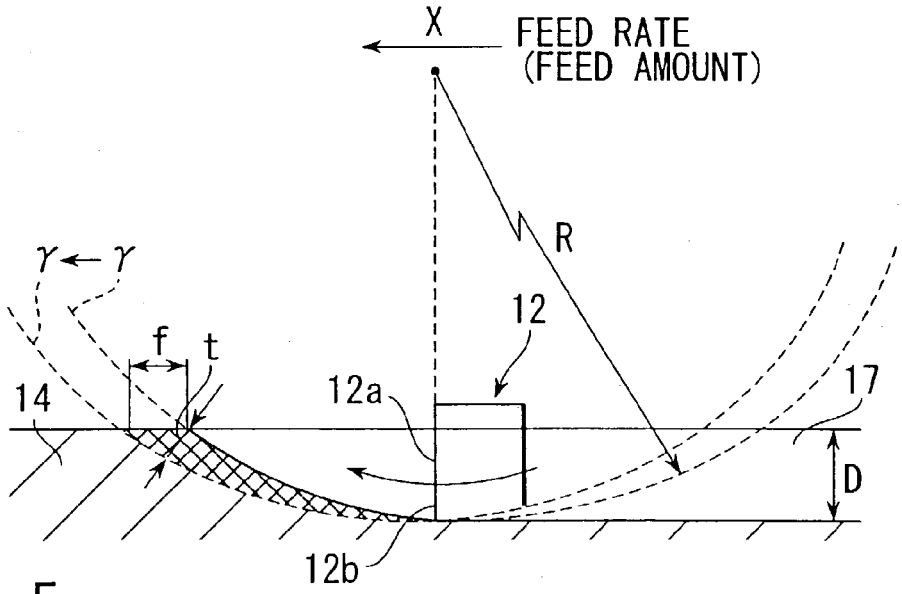
FIG. 5

ILLUSTRATION BEFORE ZERO-CUT (X1,000)

ILLUSTRATION AFTER ZERO-CUT (X1,000)

Ni TOOL (BRFORE PROCESS)

Ni TOOL (AFTER PROCESS)

WORK (AFTER PROCESS)

METHOD OF MANUFACTURING FIELD EMISSION DEVICE AND DISPLAY APPARATUS

CROSS-REFERENCE TO RELATED APPLICATIONS

This application is a divisional application of U.S. Ser. No. 09/531,158, now abandoned.

This application is based upon and claims the benefit of priority from the prior Japanese Patent Applications No. 11-076615, filed Mar. 19, 1999; and No. 11-08369, filed Mar. 30, 1999, the entire contents of which are incorporated herein by reference.

BACKGROUND OF THE INVENTION

The present invention relates in general to a method of forming emitter shapes of a field emission device. In particular, this invention relates to a method of directly forming emitter shapes or emitter-like shapes of a field emission device, and a method of forming emitter shapes on an original plate of a mold used in a transfer mold method.

With recent development of semiconductor fine-processing technology, attention has been paid to field emission devices which are micron-order fine vacuum tubes (electron guns) and the field emission devices have been widely developed.

In a proposed use of the field emission device, it may be employed as an electron emission source for an electron beam scribing apparatus or a planar display. For this use, many pointed emitter electrodes need to be arranged two-dimensionally wit high density. Where the field emission device is used as the electron emission source for the planar display, it is necessary to improve the sharpness of the pointed portion of each emitter electrode, thereby to decrease a drive voltage of the device.

There are following problems with the prior-art method of manufacturing the field emission device, as will be stated below.

In the prior art, emitter electrodes are pointed by means of superposing exposure or anisotropic etching using semiconductor fabrication technology. The reproducibility in the process of pointing the emitter electrodes is poor, and it is difficult to uniformly produce many emitter electrodes.

In this case, the degree of sharpness of pointed portions of emitter electrodes depends on the resolving power of the exposure apparatus. Although the degree of pointedness of emitter electrodes depends on the resolving power of a stepper, etc. for performing mask patterning, the resolving power is limited. Consequently, the enhancement of pointedness of emitter electrodes is limited.

And in the method of manufacturing the field emission device using the semiconductor fabrication technology, the size of a substrate on which the field emission device is to be formed is limited to the size of the semiconductor wafer.

BRIEF SUMMARY OF THE INVENTION

The object of the present invention is to form fine desired emitter shapes.

In this invention, in the method of manufacturing a field emission device in which emitter shapes are formed on a work, the work is cut to produce the emitter shapes.

According to the present invention, fine emitter shapes having high pointedness can be formed with high density.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 3 is a front view showing a diamond bite;

FIG. 4 is a three-view figure of a diamond tip;

FIG. 5 is a schematic diagram showing a locus of the diamond tip;

DETAILED DESCRIPTION OF THE INVENTION

FIGS. 1 to 12 show an emitter electrode manufacturing method according to a first embodiment of the present invention. In this method, a surface portion of a substrate is so cut as to produce an emitter shape array (emitter array) of a field emission device. In addition, a final product such as a planar display device is obtained.

Figure 1:
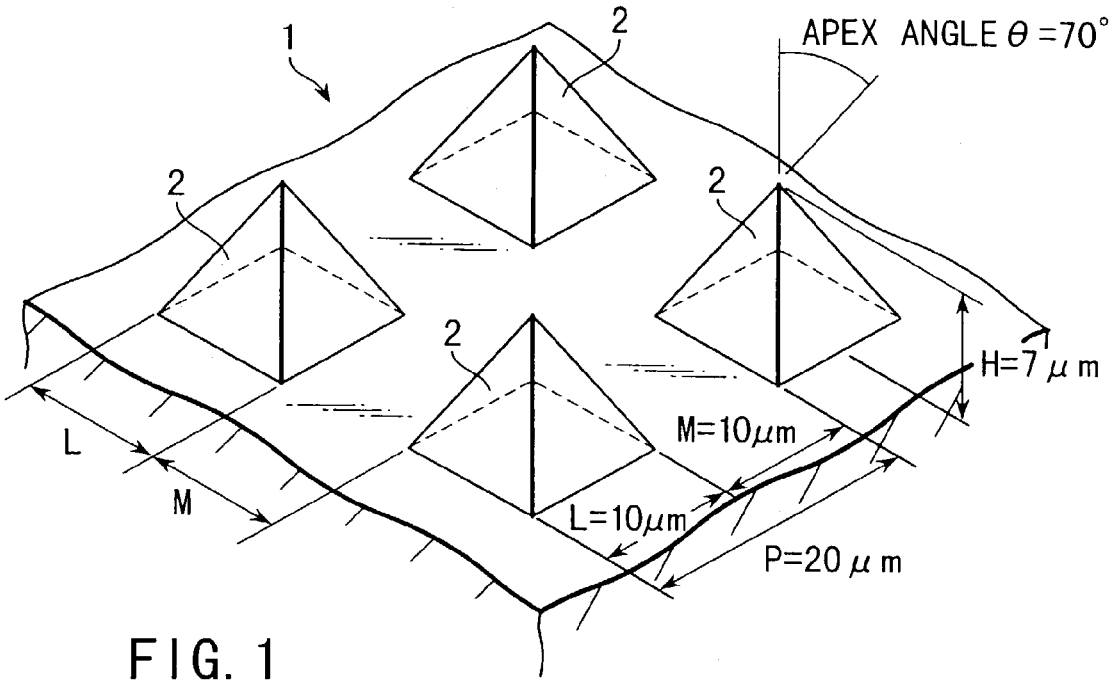
FIG. 1 is an enlarged perspective view showing an array of emitter shapes which are cut out according to a first embodiment of the present invention.

FIG. 1 is an enlarged view showing an emitter array 1 (an array of emitter shapes 2) produced by this method. Each emitter shape 2 is a regular pyramid. The length L of each side is 1 to 50 μm, the apex angle θ s 30° to 120° (preferably about 70° ), and the height H is 1 to 50 μm. The emitter shapes 2 are arranged in a matrix with interval M=1 to 50 μm and the pitch P=1 to 100 μm.

In the case of a field emission device applied to, e.g. a planar display device (FED: Field Emission Display), the number of emitter shapes 2 to be formed per pixel needs to be about 150, with each row being about 5×3 ("3" is the number of RGB) and each column being about 10. If the size of the screen of the FED is 1000 (row)×about 800 (column), the total number of emitter shapes 2 on the screen is about 15,000×800.

Figure 2:
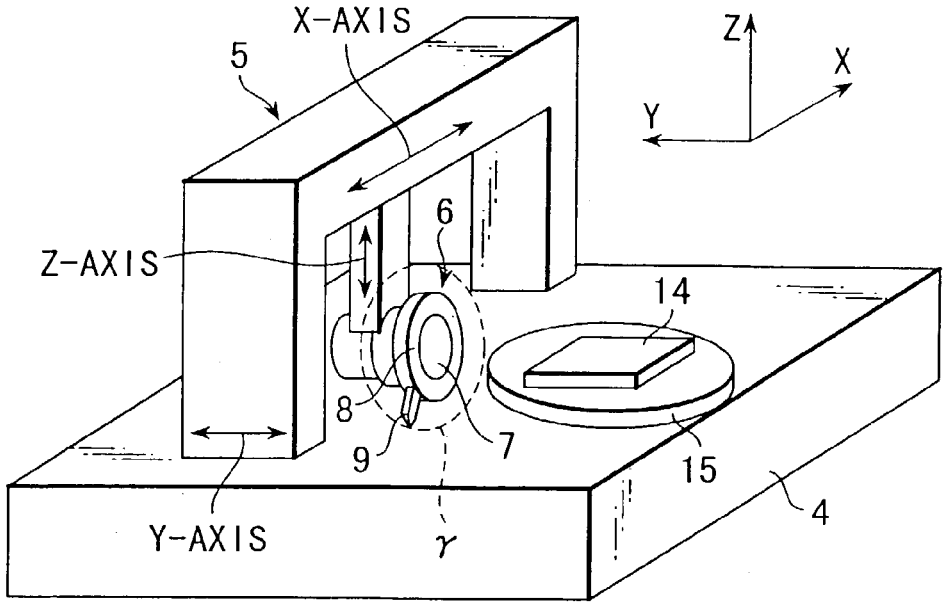
FIG. 2 is a perspective view showing a cutting apparatus.

This embodiment provides a method of producing the emitter array 1 comprising 15,000×800 emitter shapes 2 at a time by means of a cutting apparatus as shown in FIG. 2.

This cutting apparatus is a gate-type NC processing machine. A gate-shaped head 5 mounted on a frame 4 holds a main shaft device, denoted by 6 in FIG. 2, such that the main shaft device 6 can be positioned in the X-, Y- and Z-directions. The main shaft device 6 has a high-speed air spindle (not shown) and a main shaft 7 driven by the air spindle. A diamond bite (rotary tool) 9 is attached to a distal end portion of the main shaft 7 via a disc-shaped bracket 8. The diamond bite 9 is attached in such a manner as to project radially outward of the main shaft 7.

This diamond bite 9, as shown in FIG. 3, comprises a shank 11 fixed to the main shaft 7 and a diamond tip 12 adhered to a distal end portion of the shank 11.

FIG. 4 shows a shape of a cutting blade of the diamond tip 12. The diamond tip 12 has a cutting face 12*a*, an end cutting edge 12*b*, a side cutting edge 12*c*, an end cutting edge flank 12*d*, and a side cutting edge flank 12*e*. The end cutting edge width W and apex angle ϕ of the cutting face 12*a* are designed to be equal to the interval M and apex angle θ of the emitter shape 2 (see FIG. 1). The end cutting edge clearance angle α and the side cutting edge clearance angle β are set at 3° respectively.

As is shown in FIG. 2, a substrate 14 or a work is held on a rotational positioning table 15 on the frame 4. The substrate 14 is, for example, an original plate for fabricating a mold used when emitter electrode of a field emission device are formed by a transfer mold process. The substrate 14 has an area corresponding to a projection area of all pixels of the FED.

A process of forming emitter shapes 2 on a surface of the substrate 14 will now be described with reference to FIGS. 2, 5 and 6A to 6C.

The gate-shaped head 5 shown in FIG. 2 is actuated to drive the main shaft device 6 in the X- and Y-directions. Thus, the diamond bite 9 is positioned to face the substrate 14. The main shaft device 6 is actuated to rotate the diamond bite 9. The end cutting edge 12*b* of diamond tip 12 moves while describing a circular locus indicated by a dotted line γ in FIG. 2.

In this state, the main shaft device 6 is lowered in the Z-direction, and the diamond bite 9 is made to cut into the substrate 14 by a predetermined cut depth D and moved in the X-direction at a predetermined feed rate. Thereby, as shown in FIG. 5, a surface portion (indicated by hatching) of the substrate 14 is cut out by the cutting face 12*a* of diamond tip 12, and a groove 17 having the same cross-sectional shape as the cutting face 12*a* of tip 12 is formed.

A feed amount f (feed rate F) per unit time of the main shaft device 6 in the X-direction is determined on the basis of a maximum cut-out thickness t for a single cutting operation, as shown in FIG. 5. In order to control a chip or breakage occurring in the process and to reduce a radius of a tip end of each emitter shape 2 to, e.g. 30 nm or less, it is necessary to reduce the maximum cut-out thickness t to a predetermined value or less, preferably t≦10 μm, more preferably t≦1 μm.

On the basis of the geometrical relationship among the number of revolutions, S, of the diamond bite 9, the tool feed rate F (=f·dx/dt), the cut depth D, and the radius R of rotation of the bite edge, the maximum cut-out thickness t is given by $$t=(F/S)\cdot\{2(D/R)-(D/R)^2\}^{1/2}$$

It should suffice if the tool feed rate F is determined based on this equation.

Figure 6A:
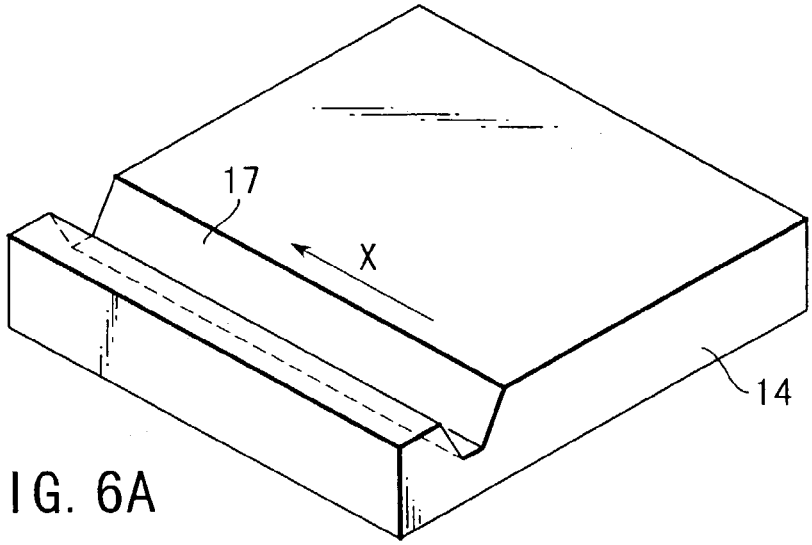
FIG. 6A illustrates a step of cutting out emitter shapes.
Figure 6B:
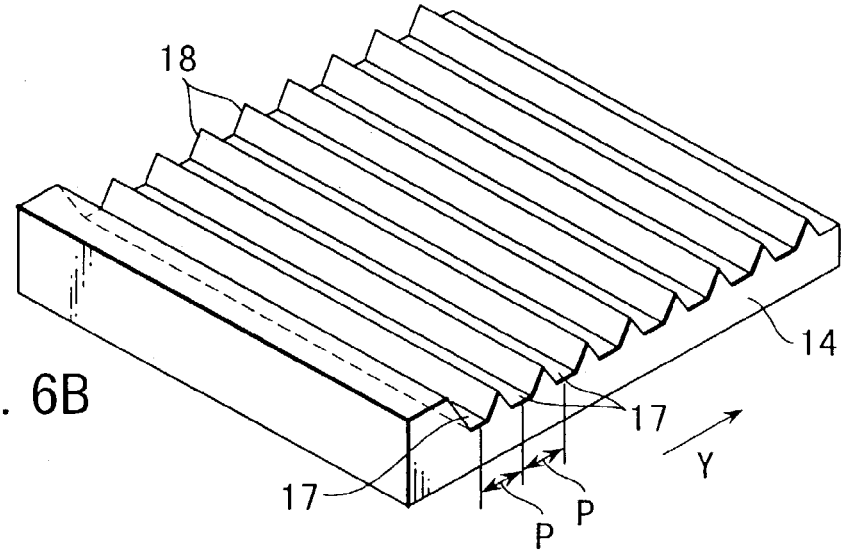
FIG. 6B illustrates a step of cutting out emitter shapes.

FIG. 6A is a perspective view showing the groove 17 formed in the above step. Plural grooves 17, as shown in FIG. 6B, can be formed by repeating the above step, that is, by feeding the diamond bite (main shaft device) in the Y-direction with a pitch P (=L+M). With the formation of the grooves 17, triangular ridges can be defined in between the grooves 17.

Figure 6C:
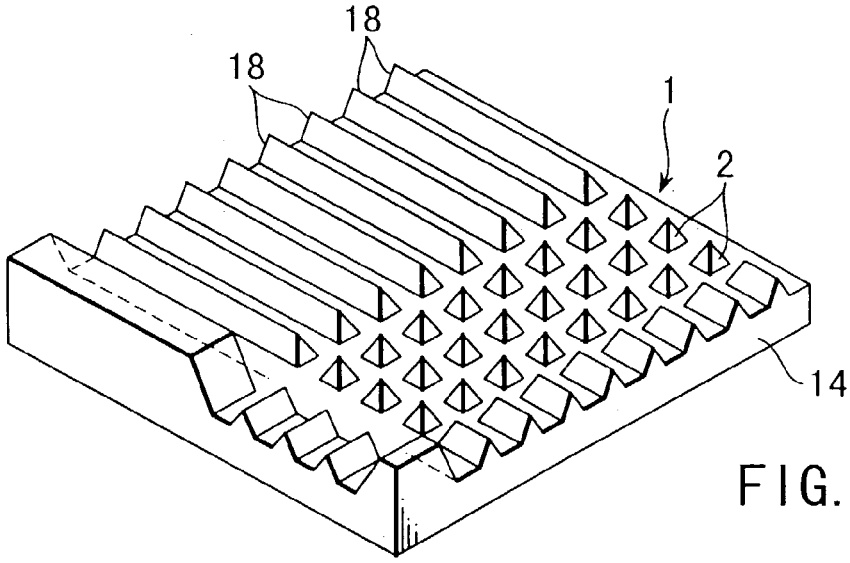
FIG. 6C illustrates a step of cutting out emitter shapes.

Subsequently, the table 15 is rotated over 90° and the same cutting steps as illustrated in FIGS. 6A and 6B are performed. Accordingly, as shown in FIG. 6C, only intersections of the triangular ridges are left and an array 1 of regular-pyramidal emitter shapes 2 can be cut out over the entire surface of the substrate 14.

In this state, burr may form along ridgelines of emitter shapes 2 due to fluidity of the work. Where there is a need to remove the burr, the cutting operation along the same loci as illustrated in FIGS. 6A to 6C is repeated ("zero-cut"). If a waste is not completely removed by the zero-cut, it can be removed by a washing step such as ultrasonic washing using acetone.

With the above structure, the emitter shapes 2 can be formed by cutting, without using semiconductor microfabrication technology. Therefore, the following advantages can be obtained.

First, since the substrate 14 is not limited to a semiconductor wafer, the emitter array 1 can be formed at a time on the area corresponding to all pixels of a large-sized FED.

Second, since no semiconductor fabrication process, such as exposure or etching, is not used in forming the emitter shapes 2, sharpening of the emitter shape is not limited by an exposure resolution or isotropy in a removal step and uniform emitter shapes can be obtained. In addition, as will be shown in an embodiment described later, a very sharp emitter shape with a tip end having a radius of curvature of 30 nm or less can be obtained.

Third, since a cutting process is performed using a rotary tool (diamond bite 9), the amount of cut for a single cutting operation can be remarkably reduced. Thus, occurrence of a chip, etc. can be prevented, and a very sharp emitter shape can be obtained.

The method of the present invention is applicable to a case where emitter shapes are formed on the original plate for fabricating the mold for forming emitter electrodes by means of the transfer mold process, as described above, as well as to a case where emitter electrodes of the field emission device are directly formed by the cutting.

Figure 7:
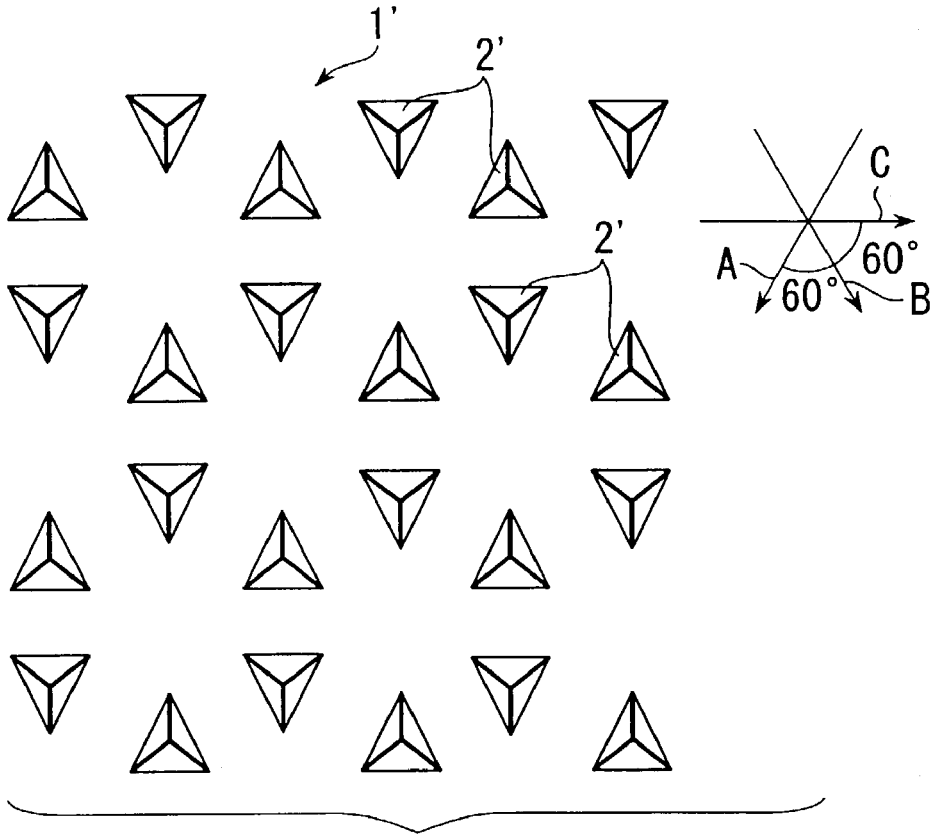
FIG. 7 is a plan view showing an array of triangular emitter shapes.

The emitter shape 2 is not limited to a regular-pyramidal one, but may be a triangular-pyramidal one, as shown in FIG. 7. This shape is realized by performing the same cutting operation as above in directions A, B and C, with the substrate rotated in units of 60°.

In the case of the regular pyramid, it is possible that a portion, which is to become an apex, is truncated due to improper setting of the feed amount or an error in positioning of the cutting apparatus. In the case of the triangular pyramid, on the other hand, the apex can be exactly formed.

Figure 8:
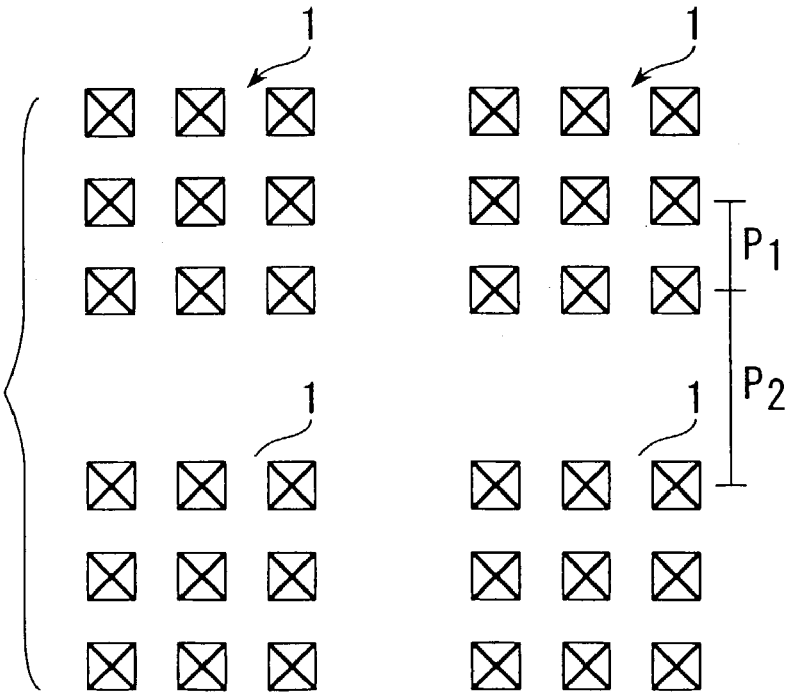
FIG. 8 is a plan view showing an example of an array of unevenly distributed emitter shapes.

In an example of the emitter shape array 1 shown in FIG. 8, the emitter shapes are unevenly distributed. Using the above cutting process, this structure can be obtained by changing the feed pitch P1, P2 in the Y-direction.

Figure 9:
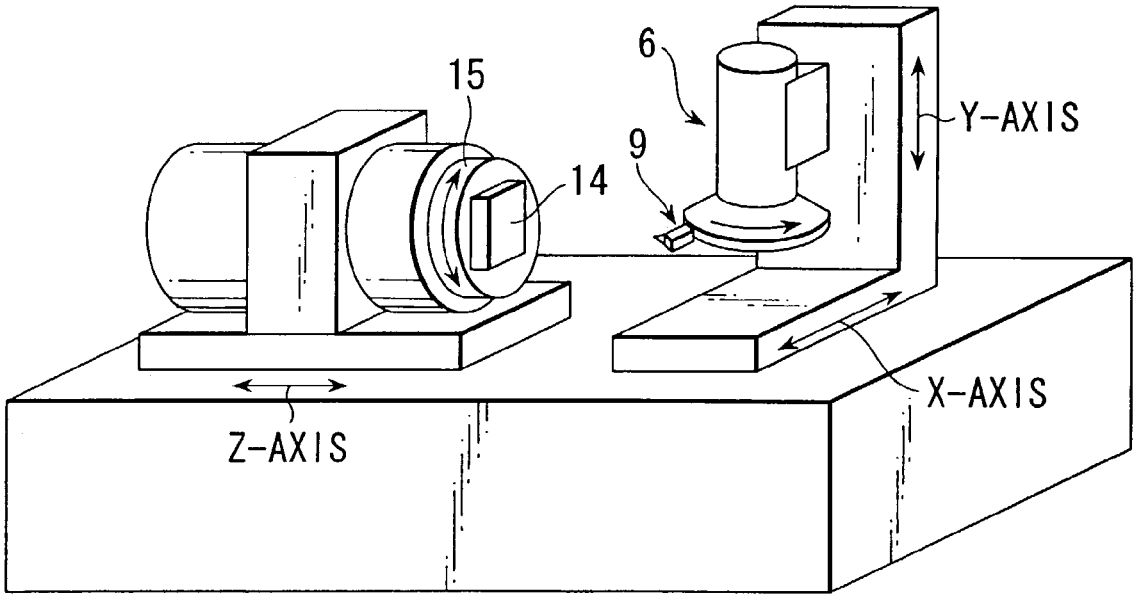
FIG. 9 is a perspective view showing another example of the cutting apparatus.

The structure of the cutting apparatus is not limited to that shown in FIG. 2, but may be a structure as shown in FIG. 9.

In the apparatus shown in FIG. 2, the diamond bite 9 is rotated about a horizontal axis. On the other hand, in the apparatus shown in FIG. 9, the diamond bite 9 is rotated about a vertical axis. With this apparatus, too, the same cutting operation as with the above-described apparatus can be performed.

With the apparatus shown in FIG. 9, cut chips produced from the substrate 14 are carried away in the direction of gravity of the diamond bite 9 and easily adhere to a lower part of the work. If chips adhere to a surface of the work before grooves are formed, the chips may easily been caught between the diamond bite 9 and the processed surface at the time of cutting. It thus becomes difficult to form grooves with high precision. This being the case, the diamond bite 9 is moved during the processing of grooves in a direction substantially perpendicular to the direction of gravity. It is preferable that grooves are successively formed by repeating the processing of grooves from below upward. It is also preferable that such chips be removed by spraying mist-like kerosene to a point of processing in pursuit of the diamond bite 9 which is moved in a direction substantially perpendicular to the direction of gravity. This is effective both in a standpoint of removal of chips from between the work and the tool and in a standpoint of better lubrication between the diamond bite 9 and the work. The chips remaining on the surface of the work after the processing can be removed by washing.

EXAMPLE ACCORDING TO THE FIRST EMBODIMENT

As an example according to the first embodiment, an emitter shape array 1 was fabricated, wherein the length L of each side was 10 μm, the apex angle θ as 70°, the height H was 7 μm, and the pitch P was 20 μm. The obtained product is an original plate (14) for forming an emitter array, which constitutes a part of an FED apparatus with a screen size of 40 inches, on a mold used in the transfer mold process.

Figure 10:
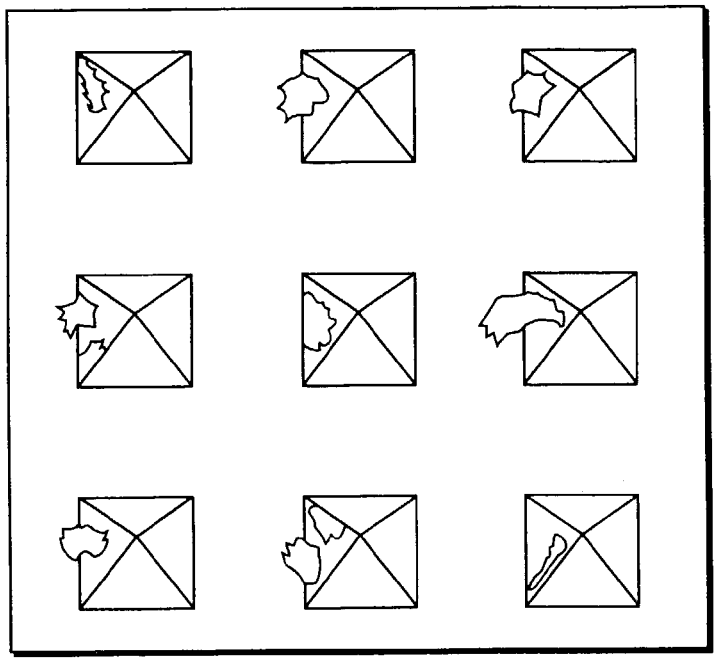
FIG. 10 is a illustration showing emitter shapes before zero-cut is effected.
Figure 11:
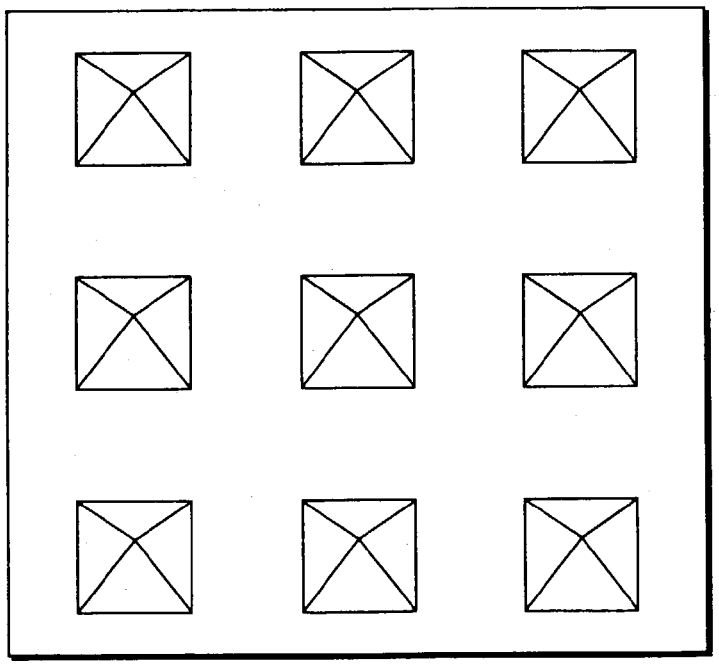
FIG. 11 is a illustration showing emitter shapes after zero-cut is effected.

FIGS. 10 and 11 show illustrates. FIG. 10 is a illustrate showing emitter shapes cut out by the cutting process. FIG. 11 is a illustrates showing emitter shapes after zero-cut.

The processing precision and processing conditions of the cutting apparatus used in forming the emitter shape array are shown below.

(1) Processing Precision of the Cutting Apparatus

① Air spindle of the main shaft device . . . radial rotational run-out=0.05 μm or less, axial rotational run-out=0.05 μm or less.

② Gate-shaped head:

Z-axis . . . stroke=100 mm or more, straightness=0.1 μm or less, squareness=0.1 μm or less, positioning precision=10 μm or less.

Y-axis . . . stroke=800 mm or more, straightness=0.8 μm or less, squareness=0.8 μm or less, positioning precision=10 μm or less.

X-axis . . . stroke=800 mm or more, straightness=0.8 μm or less, squareness=0.8 μm or less, positioning precision=10 μm or less.

③ Diamond bite:

shank . . . depth=8 mm, width=8 mm, length 60 mm, diamond tip . . . apex angle=70°, end cutting edge length=10 μm, cutting edge height=2 mm, end cutting edge clearance angle=3°, side cutting edge clearance angle=3°, height from the center of the main shaft to the apex of the diamond tip=60 mm.

(2) Processing Conditions main shaft rotational speed: S=2000 $min^{-1}$

X-axis feed rate: F=100 mm/min cut depth: D=0.01 mm cut-out amount=t≦1 μm

Y-directional feed pitch=20 μm.

SECOND EMBODIMENT

Figure 12:
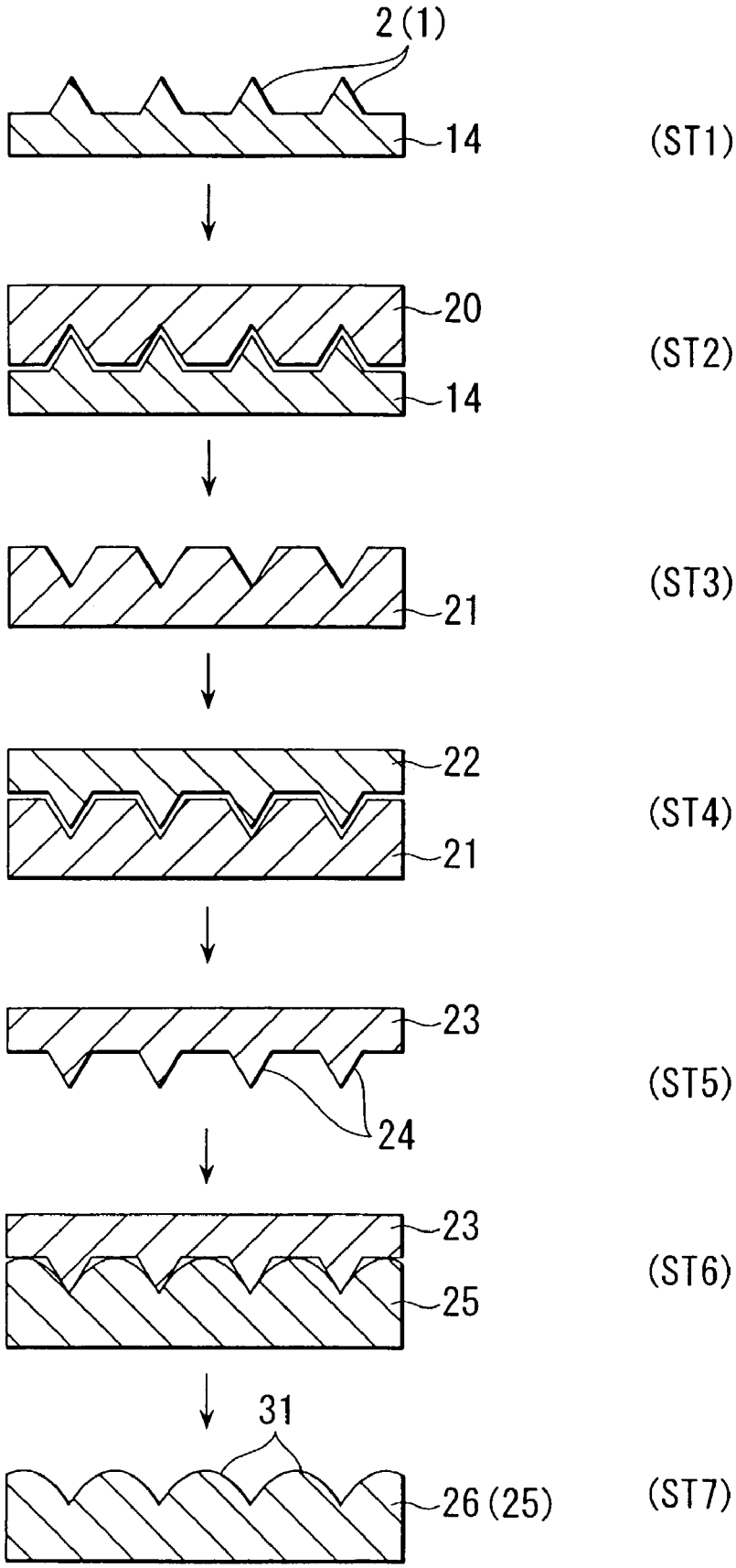
FIG. 12 illustrates steps of forming a mold used in a transfer mold according to a second embodiment of the present invention.

FIG. 12 illustrates a process of fabricating an emitter electrode according to a second embodiment of the present invention. In this process, the original plate 14 formed by the first embodiment is used to fabricate an emitter electrode of a field emission device.

According to the method of the first embodiment, a substrate 14, which has a size corresponding to a surface area required by the display and is plated with oxygen-free copper of about 38 Hv, aluminum (1060-O) of about 17 Hv and a non-electrolytic Ni plating layer, is cut to obtain the original plate 14 having the emitter array 1 (step ST1). The above-mentioned metals may be replaced with other metals with high malleability and ductility which have surface roughness Ra=about 0.01 μm and are easily subjected to mirror finishing.

Then, the surface of the original plate 14 is degreased and then activated with a fluoride such as ammonium fluoride. Subsequently, using a method by means of non-electrolytic Ni plating or electrolytic Ni plating, a Ni electro-typing layer 20 of electrolytic Ni for primary transfer with, e.g. 500 Hv is applied to the original plate 14 (step ST2). The thickness of the Ni electro-typing layer 20 is, e.g. about 50 μm. Then, the Ni electro-typing layer 20 is separated from the original plate 14. Thus, a Ni electro-typing mold 21 is obtained (step ST3). The surface of the Ni electro-typing mold 21 is degreased or anodized so that adhering matter may be easily removed. A Ni electro-typing layer 22 of non-electrolytic Ni for secondary transfer with 550 Hv is applied to the Ni electro-typing mold 21 (step ST4). Where the thickness of the Ni electro-typing layer 22 is small and adequate mechanical strength is not obtained, a lining such as a glass substrate may be provided. Then, the Ni electro-typing layer 22 is separated from the Ni electro-typing mold 21, and a Ni electro-typing substrate 23 is obtained (step ST5). The Ni electro-typing substrate 23 has a surface area corresponding to all pixels of the FED apparatus and an array 24 of emitter shapes. Accordingly, the Ni electro-typing substrate 23 can be directly applied to a field emission device. Since a plurality of Ni electro-typing substrates 23 can be obtained from the original plate 14, the time for processing can be greatly reduced.

Using the thus obtained Ni electro-typing substrate 23 as a tool, a female mold can further be obtained.

Following step ST5, the Ni electro-typing tool 23 is pressed on a substrate 25 having a surface area corresponding to all pixels of the FED. Thus, a mold 26 for transfer molding is obtained by a single pressing operation (step ST6).

Figure 13A:
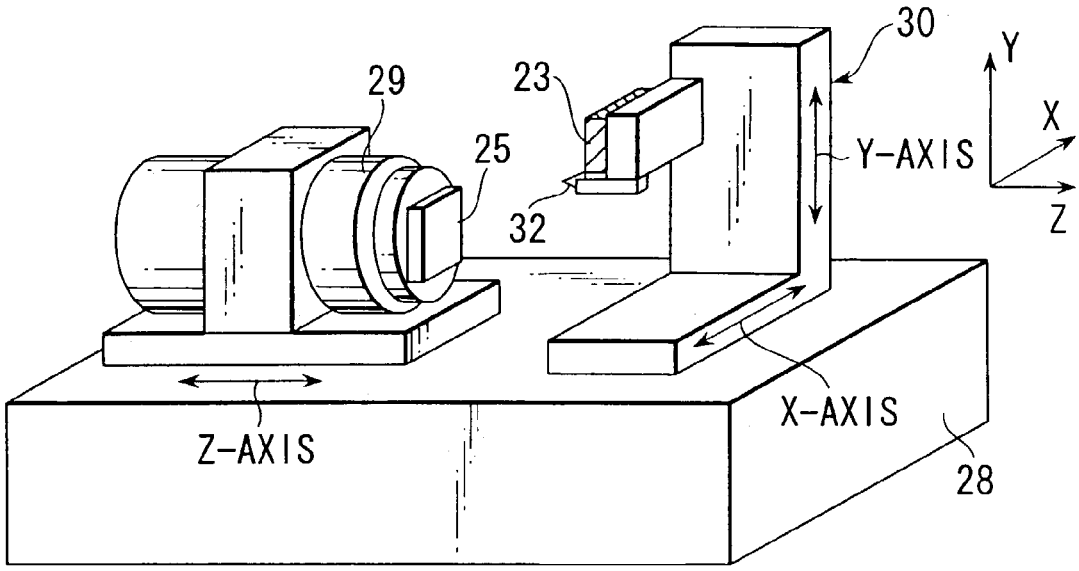
FIGS. 13A and 13B are perspective views showing pressing apparatuses for pressing electro-typing devices upon substrates serving as molds.

FIG. 13A shows a pressing apparatus for effecting the above press. The pressing apparatus comprises a frame 28; a Z-axis table 29, provided on the frame 28, for holding a substrate 25 or a work in such a state that the surface of the substrate 25 is set perpendicular to the Z-axis and for positioning the substrate 25 in the Z-axis direction; and an XY-drive head 30 for holding the electro-typing tool 23 in such a state that the electro-typing tool 23 is opposed to the surface of the substrate 25 and for positioning the electro-typing tool 23 in the X- and Y-directions.

With this pressing apparatus, the electro-typing tool 23 is positioned by the XY-drive head 20 to be opposed to the surface of the substrate 25. In addition, the substrate 25 is driven in the Z-axis direction. Thus, the surface of the substrate 25 can be pressed on the electro-typing tool 23.

The press is effected by pushing the emitter shapes 24 of electro-typing tool 23 into the substrate 25 by a predetermined depth, keeping this state for a time period (e.g. 10 seconds) necessary for plastic deformation, and pulling the emitter shapes 24 out of the substrate 25.

In the pressing process, swells 31 may form on the surface of the substrate 25 due to a factor of material, etc. (see FIG. 12) and the surface flatness may deteriorate. To overcome this problem, for example, a flattening diamond bite 32 may be mounted in the vicinity of the electro-typing tool 23 of the pressing apparatus shown in FIG. 13A. On the other hand, the substrate 25 is attached to the Z-axis table 29, and the swells 31 on the surface of substrate 25 are cut out and flattened by means of the diamond bite 32, thereby to obtain a predetermined flatness.

According to this structure, the mold having the size corresponding to the entire area of the FED apparatus can be obtained by a single pressing operation.

In this embodiment, the electro-typing tool 23 having the size corresponding to the entire surface of the FED is employed and this tool 23 is pressed on the substrate 25 so that the mold 26 for transfer molding can be obtained by a single pressing operation. The present invention, however, is not limited to this embodiment. It is possible to use a relatively small electro-typing tool and to pressing it several times, thereby to obtain a mold having a size corresponding to the entire surface of the FED.

Figure 14A:
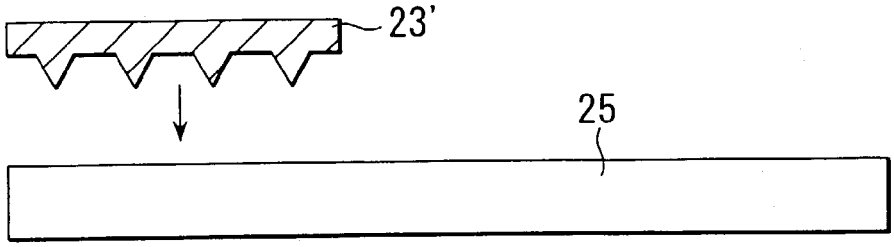
FIGS. 14A to 14F illustrate steps of another example of the mold forming step.
Figure 14B:
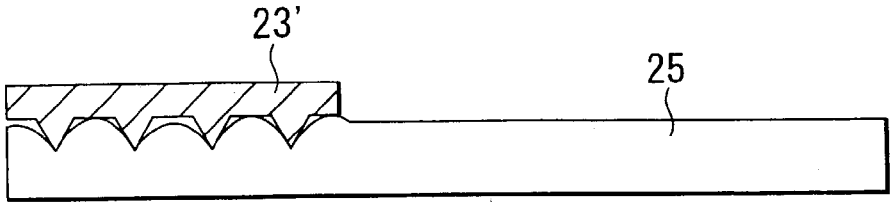
Figure 14C:
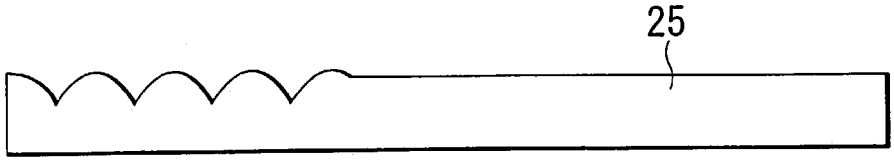
Figure 14D:
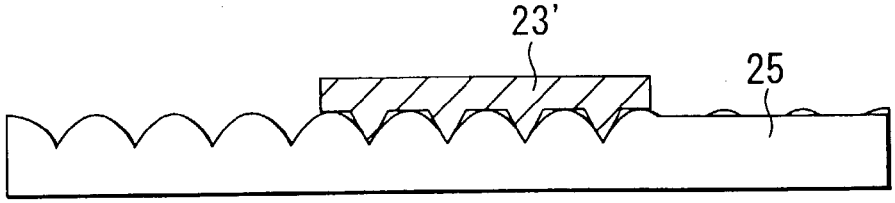
Figure 14E:
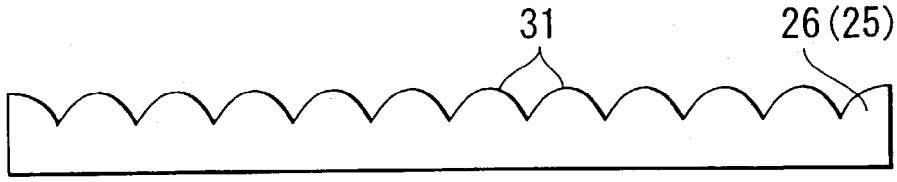
Figure 14F:
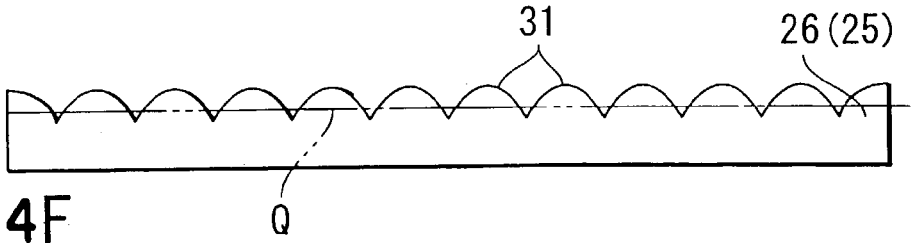

For this purpose, as illustrated in FIGS. 14A to 14E, an electro-typing tool 23' is pressed several times while the press position is being displaced. Thereby, a mold 26 having a size corresponding to the entire surface of the FED is obtained by pressing. At last, to attain desired flatness, the resultant structure is cut along a two-dot-and-dash line Q as illustrated in FIG. 14F. For example, where the repeated pressing process is performed using the electro-typing tool 23' having 1,000×1,000 emitter array 24', it is assumed that the number of arrays of the Fed is 15,000×8,000 and the time needed for a single pressing operation is about 60 seconds. In this case, $$(15{,}000/1{,}000)\times(8{,}000/1{,}000)\times 60\ \text{sec}=2\ \text{hour}.$$

Thus, the mold can be fabricated in a very short time, i.e. about two hours.

In this case, too, swells 31 may form on the surface of the substrate. Such swells 31 may be cut out by the above-described flattening process after the pressing process.

The electro-typing tool 23' may be fabricated by subjecting a silicon substrate to exposure and anisotropic etching.

Figure 13B:
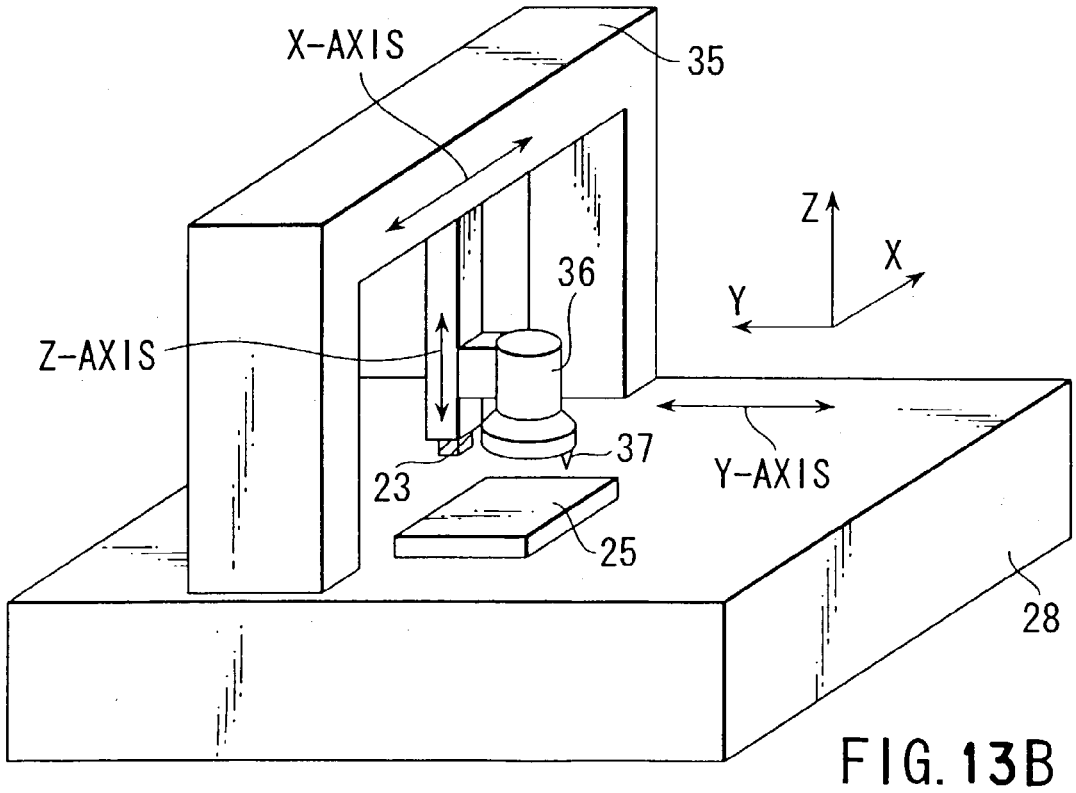

The pressing apparatus is not limited to that shown in FIG. 13A, and a pressing apparatus as shown in FIG. 13B may be adopted. This apparatus has a gate-shaped head 35. The gate-shaped head 35 holds the electro-typing tool 23 such that the tool 23 can be positioned in the X-, Y- and Z-directions. The gate-shaped head 35 holds a flattening process head 36. The flattening process head 36 has a main shaft (not shown) which is rotatable about a Z direction. A diamond bite 37 is attached to the main shaft. With this apparatus, too, the same pressing process as with the apparatus shown in FIG. 14A can be performed.

Figure 15A:
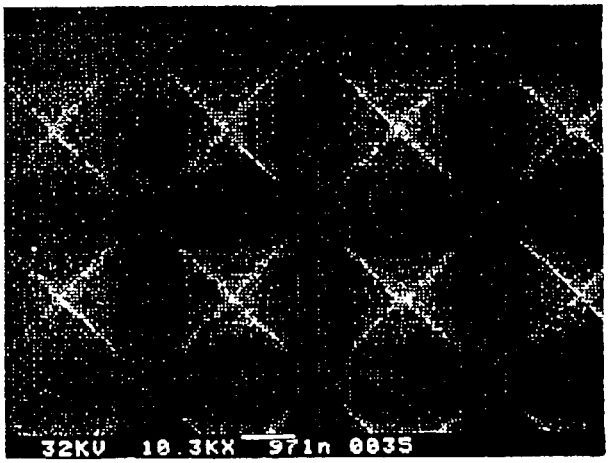
FIG. 15A is a microscopic photograph showing a tool before a process in which an emitter concave-mold is subjected to a pressing deformation process.
Figure 15B:
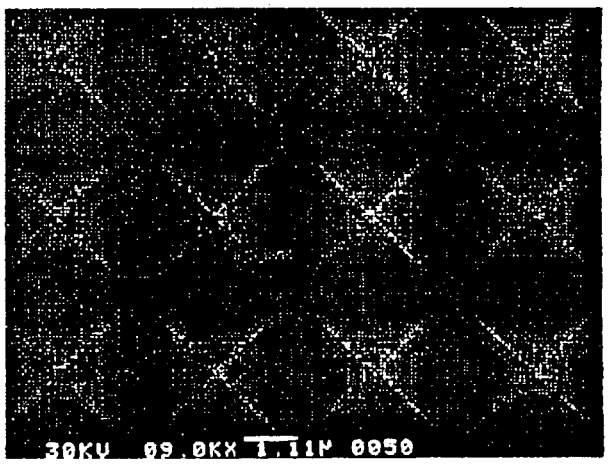
FIG. 15B is a microscopic photograph showing a tool after a process in which an emitter concave-mold is subjected to a pressing deformation process.
Figure 15C:
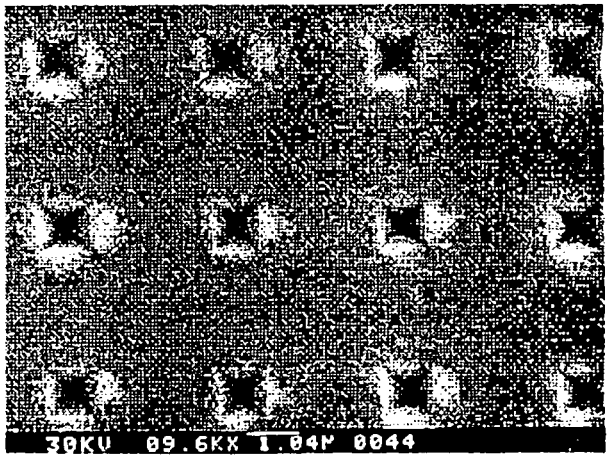
FIG. 15C is a microscopic photograph showing a work after a process in which an emitter concave-mold of an emitter is subjected to a pressing deformation process.

FIGS. 15A to 15C are microscopic photographs showing experimental results obtained by forming an emitter concave-mold by a pressing deformation process. An electrolytic Ni-plated convex original plate in which an Si concave mold pattern is transferred was used as a tool. Oxygen-free copper (C1020BD) subjected to annealing (200° C.×4 h) was used as a work. An area for processing was 4 mm×4 mm, the pressure for the pressing process was 200 to 600 N/mm$^2$, the rate of pressing was 0.2 mm/min, and the load retention time was 30 sec. FIG. 15A shows the tool before use, FIG. 15B the tool after use, and FIG. 15C the surface of the processed work. Each photograph was taken at ×10,000 magnification. The shapes of tip portions of the tool were transferred onto the work. The tip portions of the tool were rounded due to the process, and the radius of each tip portion was 50 to 100 nm. It is thus estimated that the radius of a tip portion of the emitter shape formed in the work was about 50 to 100 nm.

From the experimental results, it is considered possible that an oxygen-free copper concave-mold for emitters is fabricated by using a diamond press portion as a tool and oxygen-free copper as a work, and further an electrolytic Ni-plated original plate on which the pattern of the oxygen-free copper concave-mold is transferred is used as a tool, thereby to form a still larger oxygen-free copper concave-mold. Like the experiments, an electrolytic Ni-plated convex original plate in which an Si concave mold pattern is transferred was used as a tool.

The hardness of electrolytic Ni plating is 150 to 250 Hv in the case of a Watts bath and 400 to 500 Hv in the case of a bright plating bath. On the other hand, the hardness of non-electrolytic Ni plating is 550 Hv in the absence of no heat treatment and 1,100 Hv after heat treatment. While the hardness of heat-treated oxygen-free copper (C1020BD) is about 38 Hv, the hardness of heat-treated aluminum (1060-O) is about 17 Hv. It is considered therefore that the rounding of tip portions of the tool can be reduced if the material of the tool is subjected to non-electrolytic Ni plating and the work is formed of aluminum. It is desirable to select the material according to need.

Figure 16A:
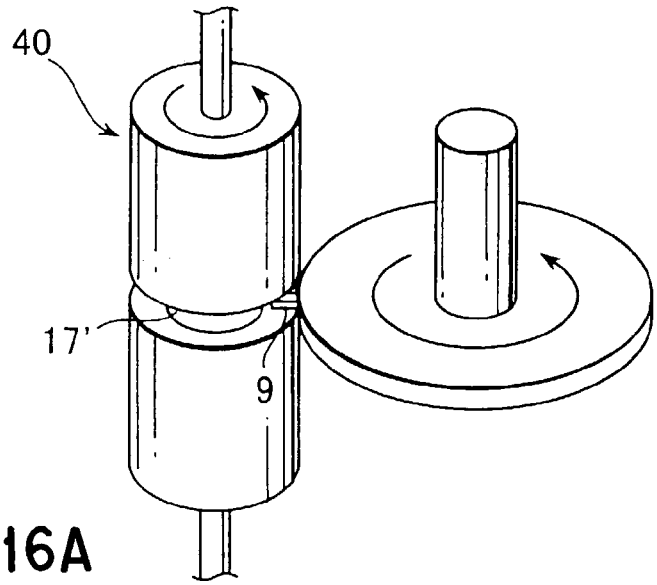
FIG. 16A shows an example of a process using a cylindrical body as a work according to a third embodiment of the present invention.
Figure 16B:
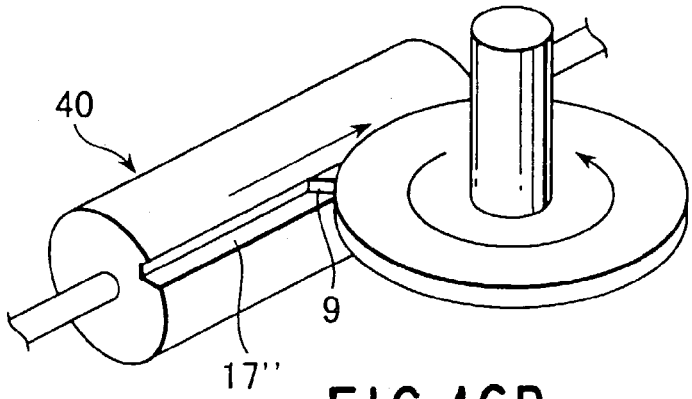
FIG. 16B shows another example of the process using a cylindrical body as a work according to the third embodiment of the present invention.
Figure 17:
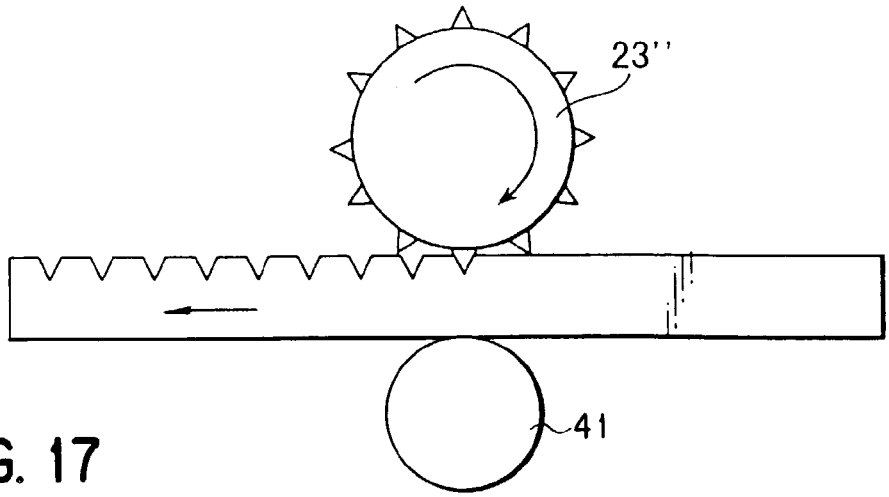
FIG. 17 shows a state in which a pressing process is performed using a cylindrical mold.

FIGS. 16A, 16B and 17 illustrate an emitter electrode fabrication method according to a third embodiment of the present invention. In the first and second embodiments, emitter shapes are formed on the surface of the substrate by cutting, but the work is not limited to the substrate. As is shown in FIG. 16A and 16B, a cylindrical body 40 may be used as a work.

In FIG. 16A, by rotating the cylindrical body 40 about its axis and abutting a rotating diamond bite 9 upon a peripheral surface of the cylindrical body 40, circumferential grooves 17' are formed in the peripheral surface. Subsequently, as shown in FIG. 16B, the cylindrical body 40 is rotated over 90°. Then, while the cylindrical body 40 is being rotated about its axis with a predetermined pitch, the cylindrical body 40 and the diamond bite 9 are moved relative to each other along the axis of the cylindrical body 40. Thus, grooves 17" are formed perpendicular to the grooves 17'. Accordingly, the same process as illustrated in FIGS. 6A to 6C can be performed, and emitter shapes can be formed over the entire peripheral surface of the cylindrical body 40.

According to this processing method, a cylindrical tool 23" is formed, as shown in FIG. 17. The tool 23" is pressed on a substrate while the tool 23" is being rotated about an axis parallel to the substrate and translated in parallel relative to the substrate. The emitter shapes can thus be transferred successively onto the substrate 25 which will become the mold. In FIG. 17 referance numeral 41 denotes a roller which cooperates with the tool 23" to clamp the substrate.

Figure 18:
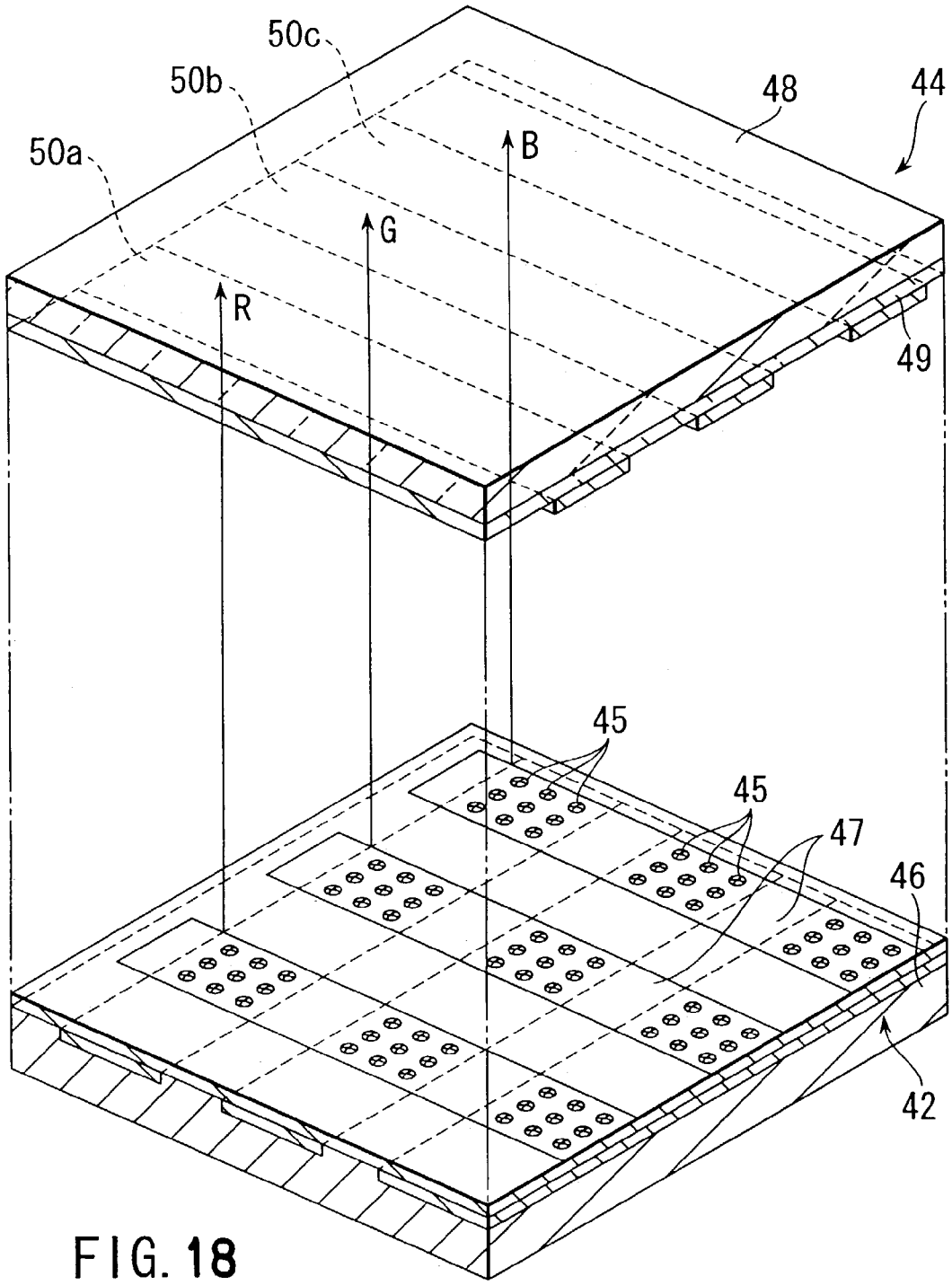
FIG. 18 is an exploded perspective view showing an FED (field emission display)

FIG. 18 shows a main part of a planar display device (field emission display (FED)) according to a fourth embodiment of the invention. The FED is obtained by using a field emission device fabricated according to the emitter shape fabrication methods of the first to third embodiments.

FIG. 18 is an exploded view showing only a component of the FED, which corresponds to one pixel.

The FED generally comprises a cathode device 42 disposed on a back side thereof and an anode device 44 disposed on a display surface side thereof.

The cathode device 42 comprises a substrate 46 on which emitter electrodes 45 (emitter shapes 2) are formed according to the above described method, and gate electrodes 47 provided over the substrate 46 with insulating layers (not shown) interposed therebetween. Each gate electrode 47 has openings for passing of pointed distal end portions of emitter electrodes 45. Silicon oxide films or silicon nitride films serving as the insulating layers, which are formed by means of a CVD process, a sputtering process, an electron beam evaporation process or a printing process, are formed between the gate electrodes 47 and substrate 46. The gate electrodes 47 are provided on the insulating layers. The gate electrodes 47 are formed such that a removal process, such as CMP, CDE, RIE or wet etching, is applied to a layer formed by electroless plating, electroplating, a printing process, a sputtering process or an evaporation process using a material such as Ni, Cr, W or an alloy thereof, thereby forming openings surrounding tip portions of the emitter electrodes 45.

In an evacuated environmental, a predetermined voltage is applied between the gate electrodes 47 and emitter electrodes 45, and electrons are emitted from tip end portions of the emitter electrodes 45. Specifically, the gate electrodes 47 and emitter electrodes 45 are connected to drive circuits (not shown), and electrons can be emitted from desired emitter electrodes 45 by a matrix control.

On the other hand, the anode device 44 comprises a light-transmissive substrate 48 such as glass; anode electrodes 49, such as ITO films, formed on that side of the light-transmissive substrate 48 which faces the cathode device 42; and R, G and B phosphor films 50*a*, 50*b* and 50*c* provided on the respective anode electrodes 49. The anode electrodes 49 are connected to a drive circuit (not shown). With application of a predetermined voltage between the anode electrodes 49 and emitter electrodes 45, electrons emitted from the emitter electrodes 45 can be controlled.

Accordingly, electrons can be let to impinge upon desired phosphor films, and a desired image can be displayed through the light-transmissive substrate 48.

According to this FED, high-luminance display can be effected and, unlike conventional liquid-crystal displays, back-lights are not needed. Moreover, since the thickness of the FED can be reduced, it can be applied to a wall-hung TV.

Needless to say, the present invention is not limited to the above-described FED and this invention can be modified without departing from the spirit of the invention.

As has been described above, this invention can provide fine, high-sharpness emitter shapes arranged at high density.

The above-described emitter has a simple pyramidal shape. However, by varying the shape of the edge of the bite, emitters with various profiles can be obtained. As regards the variation of the edge shape, there are two methods: use of a plurality of tools (bites) having different edge shapes, and use of a single tool (bite) with an edge shape corresponding to a desired profile. From the standpoint of ease in fabricating the tool, the latter is more practical.

Figure 19A:
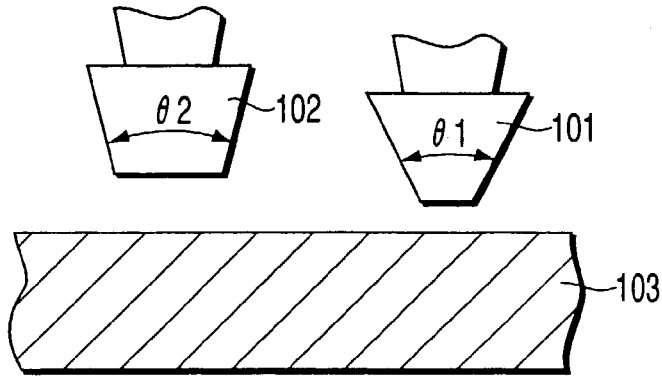
FIG. 19A is a schematic view showing a state before grooves are formed using a plurality of diamond chips.
Figure 19B:
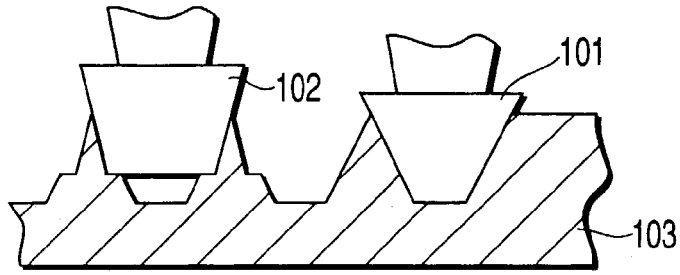
FIG. 19B is a schematic view showing a state in which grooves are being formed using the plural diamond chips.
Figure 19C:
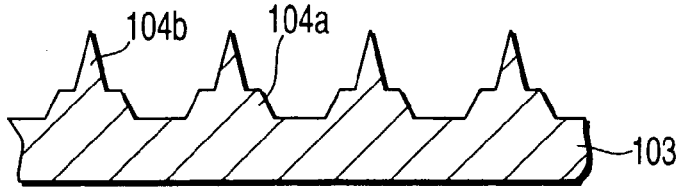
FIG. 19C is a schematic view showing a state after grooves are formed using the plural diamond chips.
Figure 19D:
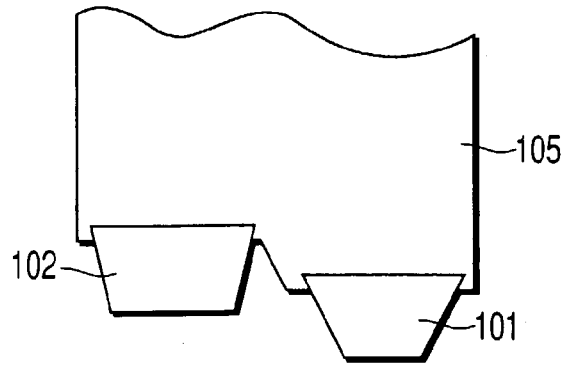
FIG. 19D is a schematic view showing a state of a tool to be used when grooves are formed using a plurality of diamond chips.

Assume that the angle with which both side edges are disposed, as viewed in a direction of cutting, is referred to as an edge angle. As is shown in FIG. 19A, there are prepared: a diamond chip 101 having an edge angle θ1, a diamond chip 102 having an edge angle θ2, and a work 103 from which an emitter shape is cut out. At first, as shown in FIG. 19B, a groove is cut in the work 103 by means of the diamond chip 101. Then, another groove with a less depth is cut along the already formed groove by means of the diamond chip 102. In this case, the width of the diamond chip 102 between the edges is set to be greater than that of the diamond chip 101 between the edges in order to partially cut both side walls of the first formed groove. Through this process, a stepped emitter shape, as shown in FIG. 19C, is formed on the work 103. This stepped emitter shape comprises a truncated pyramidal base portion 104*a* with a large apex angle and a pyramidal tip end portion 104*b* with a small apex angle, lying on the base portion 104*a*. Although a plurality of tools having diamond chips 101 and 102 fixed to different shanks may be used for processing, it is also possible to use a single tool having two diamond chips fixed on a single shank, as shown in FIG. 19D. In the latter case, if the interval between the two diamond chips is set to be equal to that between grooves to be cut, a stepped emitter shape can be obtained by a single process.

According to the present invention, an emitter shape with a non-linear profile can easily be obtained.

A certain height is required between a tip end and a bottom end of the emitter and due to a problem with mechanical strength a minimum value of the apex angle is limited. In the case of the above-described stepped emitter, adequate mechanical strength is ensured by the base portion and therefore the apex angle of the tip portion can be decreased. If the apex angle is decreased, the sharpness of the emitter is increased to permit easier emission of electrons. If an electric field emission device having such an emitter is used, an image can be provided with low power consumption.

Figure 20A:
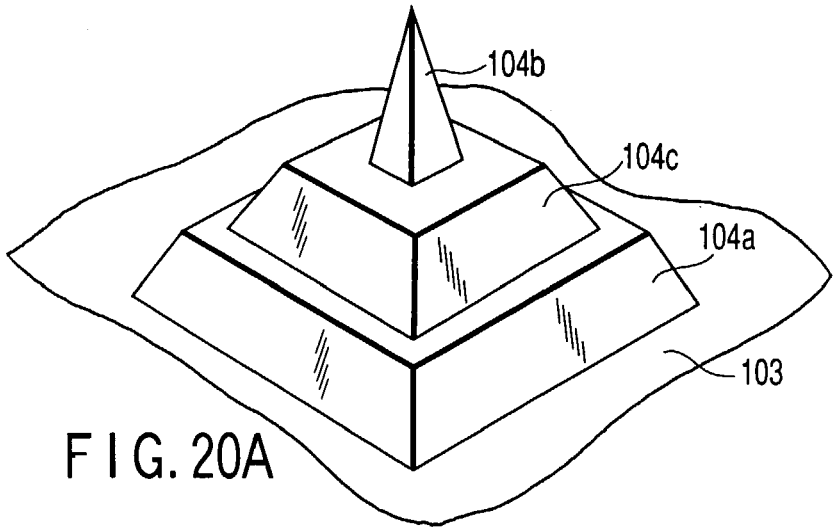
FIG. 20A is a perspective view showing a mode of a stepped emitter shape.
Figure 20B:
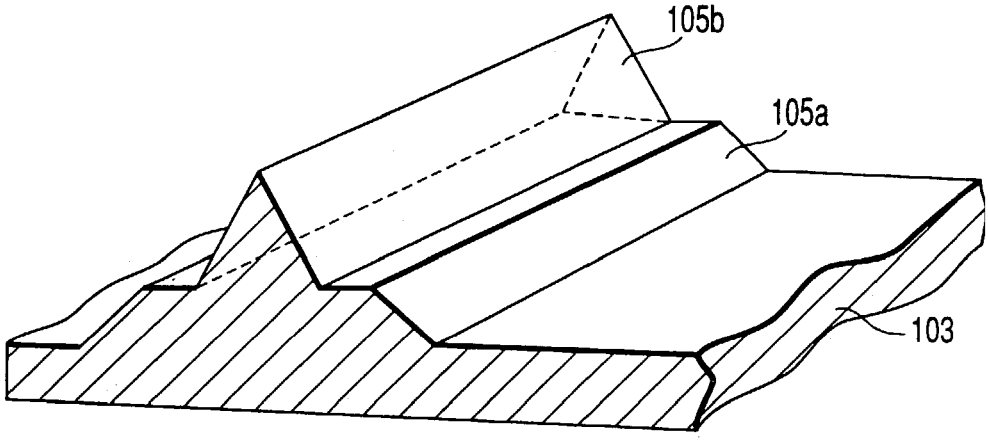
FIG. 20B is a perspective view showing a mode of a stepped emitter shape.
Figure 20C:
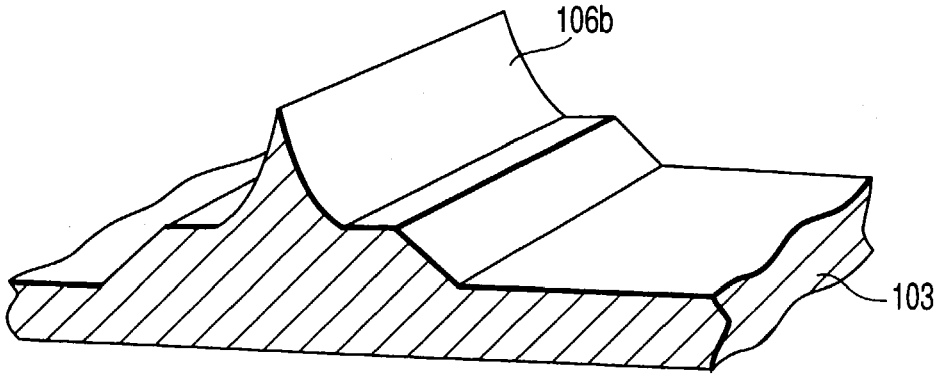
FIG. 20C is a perspective view showing a mode of a stepped emitter shape.

In addition, other various shapes, as shown in FIGS. 20A to 20C, can be realized. FIG. 20A shows an emitter shape having an intermediate portion 104*c* between a base portion 104*a* and a tip portion 104*b*. The intermediate portion 104*c*, too, can easily be obtained by properly setting the width between the edge angle and the width between edges of the tool. FIG. 20B shows an emitter shape having a wedge-shaped tip portion 105*b* and a base portion 105*a* supporting it. The wedge-shaped structure can increase a discharge current amount and contribute to enhancement in brightness. Even if the wedge-shaped tip portion may have a defect such as a crack, electrons are emitted from the normal part thereof and thus high durability is attained.

If the tool with an arcuated edge is used, an emitter shape 106*b* with an arcuated profile can be formed, as shown in FIG. 20C. Since the emitter shape is arcuated, the mechanical strength as well as sharpness thereof is easily increased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing a field emission device, in which emitter shapes are formed on a work, the method comprising the step of:

cutting into a work made of a metallic material to remove portions of the work to leave protrusions, the protrusions forming said emitter shapes on said work.

2. A method according to claim 1, wherein said work is a single body and has an area corresponding to a size of a planar display, and the emitter shapes corresponding to all pixels of the planar display are formed on said work.

3. A method according to claim 1, wherein emitter shapes are formed on a surface of the work by said cutting step, and thus emitter electrodes of the field emission device are directly formed.

4. A method of manufacturing a field emission device, in which emitter shapes are formed on a work, according to claim 1, wherein a profile of said emitter shape comprises two or more segments of a line.

5. A method of manufacturing a field emission device, in which emitter shapes are formed on a work, according to claim 1, wherein a profile of said emitter shape has a predetermined curvature.

6. A method of manufacturing a field emission device, in which emitter shapes are formed on a work, the method comprising the step of:

cutting a work made of a metallic material, thereby forming said emitter shapes on said work, and wherein in the step of forming the emitter shapes by the cutting, a plurality of grooves, each having a width gradually decreasing in a depth direction of the work, are cut in a surface portion of the work, whereby the emitter shapes are formed.

7. A method according to claim 6, wherein the step of forming the emitter shapes by the cutting includes:

a step of forming a plurality of parallel grooves in a surface portion of the work; and repeating the step of forming a plurality of parallel grooves at least twice, with the direction of the parallel grooves being changed.

8. A method according to claim 7, wherein in the step of forming the emitter shapes by the cutting, a step of forming a plurality of parallel grooves in a surface portion of the work is repeated at least twice, with the direction of the parallel grooves changed over 90°, thereby forming regular-pyramidal emitter shapes.

9. A method according to claim 7, wherein in the step of forming the emitter shapes by the cutting, a step of forming a plurality of parallel grooves in a surface portion of the work is repeated at least twice, with the direction of the parallel grooves changed over 60°, thereby forming triangular-pyramidal emitter shapes.

10. A method according to claim 6, wherein in the step of forming the emitter shapes by the cutting, a rotary tool having both side cutting edges, which are tapered toward an end of the rotary tool located radially outward of a rotational circle of the rotary tool, is employed, and said rotary tool and said work are driven relative to each other in a rotational tangential direction of the rotary tool, whereby grooves each having a width gradually decreasing in a depth direction of the work are formed.

11. A method of manufacturing a field emission device, in which emitter shapes are formed on a work, the method comprising the step of:

cutting a work made of a metallic material, thereby forming said emitter shapes on said work, and wherein the work is a cylindrical work.

12. A method of manufacturing a field emission device, in which emitter shapes are formed on a work, the method comprising the step of:

cutting a work made of a metallic material, thereby forming said emitter shapes on said work, and wherein said emitter shape has a nonlinear profile.

13. A method of manufacturing a field emission device, in which emitter shapes are formed on a work, the method comprising the step of:

cutting a work made of a metallic material, thereby forming said emitter shapes on said work, and wherein an inclination of a profile of said emitter shape becomes sharper toward a tip end thereof.

14. A method of manufacturing a field emission device, in which emitter shapes are formed on a work, the method comprising the step of:

cutting a work made of a metallic material, thereby forming said emitter shapes on said work, and wherein a profile of said emitter shape includes at least one stepped portion.

15. A method of manufacturing a field emission device, in which emitter shapes are formed on a work, the method comprising the step of:

cutting a work made of a metallic material, thereby forming said emitter shapes on said work, and wherein a cutting step is performed with a first tool having a predetermined edge angle, following which another cutting step is performed with a tool having an edge angle different from the edge angle of the first tool.

16. A method of manufacturing a field emission device, in which emitter shapes are formed on a work, the method comprising the step of:

cutting a work made of a metallic material, thereby forming said emitter shapes on said work, and wherein a cutting step is performed with a first tool having a predetermined edge angle, following which another cutting step is performed with a tool having an edge width different from an edge width of the first tool.

* * * * *